US006668493B1

(12) United States Patent
Walker

(10) Patent No.: US 6,668,493 B1
(45) Date of Patent: Dec. 30, 2003

(54) MODULAR MEDICAL GAS SERVICES UNIT

(75) Inventor: James A. Walker, Oklahoma City, OK (US)

(73) Assignee: Modular Services Company, Oklahoma City, OK (US)

( * ) Notice: Subject to any disclaimer, the term of this patent is extended or adjusted under 35 U.S.C. 154(b) by 0 days.

(21) Appl. No.: 09/994,464

(22) Filed: Nov. 26, 2001

Related U.S. Application Data

(63) Continuation of application No. 29/135,785, filed on Jan. 16, 2001, now Pat. No. Des. 452,573, which is a continuation of application No. 29/124,148, filed on May 31, 2000, now Pat. No. Des. 443,365, which is a continuation of application No. 08/781,220, filed on Jan. 10, 1997, now Pat. No. 6,256,935, which is a continuation of application No. 08/297,193, filed on Aug. 26, 1994, now Pat. No. 5,644,876.

(51) Int. Cl.[7] ..... E04C 2/52
(52) U.S. Cl. ..... 52/27; 52/220.7
(58) Field of Search ..... 52/27, 28, 36.1, 52/36.4, 220.7, 220.8, 220.1, 239; 174/48, 49; 211/26; 312/209, 223.3, 223.6

(56) References Cited

U.S. PATENT DOCUMENTS

| | | | |
|---|---|---|---|
| 2,762,387 | A | 9/1956 | Orwin |
| 3,199,063 | A | 8/1965 | Stuart |
| 3,410,302 | A | 11/1968 | Frick |
| 3,455,620 | A | 7/1969 | Coburn |
| 3,622,684 | A | 11/1971 | Press |
| 3,769,502 | A | 10/1973 | Schultz et al. |
| 3,921,345 | A | 11/1975 | Damico |
| 4,015,397 | A | 4/1977 | Flachbarth et al. |
| D244,465 | S | 5/1977 | Stoneman |
| D261,804 | S | 11/1981 | Foster et al. |
| 4,338,485 | A | 7/1982 | Fullenkamp et al. |
| 4,354,330 | A | 10/1982 | Schwartz |
| 4,387,949 | A | 6/1983 | Haitmanek |
| 4,475,322 | A | 10/1984 | Russo et al. |
| 4,621,938 | A | 11/1986 | Weilow |
| 4,627,684 | A | 12/1986 | D'Amato |
| 4,646,211 | A | 2/1987 | Gallant et al. |
| 5,044,135 | A | 9/1991 | Kroon et al. |
| 5,186,337 | A | 2/1993 | Foster et al. |
| 5,195,288 | A | 3/1993 | Penczak |
| 5,284,255 | A | 2/1994 | Foster et al. |
| 5,299,338 | A | 4/1994 | Foster |
| D361,139 | S | 8/1995 | Nomura |
| 5,618,090 | A | 4/1997 | Montague et al. |
| 5,644,876 | A | 7/1997 | Walker |
| D390,967 | S | 2/1998 | Beuster et al. |
| D390,968 | S | 2/1998 | Kummerfeld |
| D394,508 | S | 5/1998 | Nuzzio |
| D404,151 | S | 1/1999 | Reichel |
| D411,734 | S | 6/1999 | Hsiang |
| D418,603 | S | 1/2000 | Gallant |
| 6,145,253 | A | 11/2000 | Gallant et al. |
| D443,365 | S | 6/2001 | Walker |
| 6,256,935 | B1 | 7/2001 | Walker |
| D542,573 | | 12/2001 | Walker |

OTHER PUBLICATIONS

Excerpt (p. 16) from 1992 Bay Corp. catalog.

*Primary Examiner*—Michael Safavi
(74) *Attorney, Agent, or Firm*—Mary M. Lee

(57) ABSTRACT

A modular medical gas services unit with multiple medical gas outlets supported at the same level on the column. The unit preferably comprises a hollow column with an internal space for housing the gas conduits and power lines. The medical gas supply outlets are mounted so that their longitudinal axes extend radially from the vertical axis of the frame, and the longitudinal axes of adjacent outlets intersect to form an acute angle. In this way, the horizontal dimensions of the column can be minimized while the number of medical gas outlets at the desired height is maximized. In one embodiment, the column is pentagonal in cross-section providing five planar support surfaces for five medical gas outlets. In another embodiment, a square column is equipped with angled outlet panels, each supporting two medical gas outlets. Thus, though the frame is four-sided, as many as eight medical gas outlets can be mounted at the same height on the frame.

13 Claims, 6 Drawing Sheets

MODULAR MEDICAL GAS SERVICES UNIT

This application is a continuation of application Ser. No. 29/135,785, filed Jan. 16, 2001, now U,S. Pat. No. D452,573 entitled Modular Medical Gas Services Column, which is a continuation of application Ser. No. 29/124,148, filed May 31, 2000, entitled Modular Medical Gas Services Column, now U.S. Pat. No. D443,365, which is a continuation of Ser. No. 08/781,220, filed Jan. 10, 1997, entitled Modular Medical Gas Services Column, now U.S. Pat. No. 6,256,935, which is a continuation of application Ser. No. 08/297,193, filed Aug. 26, 1994, entitled Modular Medical Gas Services Column, now U.S. Pat. No. 5,644,876, and the entire contents of each these applications is incorporated herein by reference.

FIELD OF THE INVENTION

The present invention relates generally to modular medical gas services units.

BRIEF DESCRIPTION OF THE DRAWINGS

FIG. 6 is a perspective view of another embodiment of the present invention wherein the modular medical gas services column is pentagonal in cross-section and has a medical gas outlet on each side.

FIG. 9 is an enlarged, perspective view of a portion of the modular medical gas services column shown in FIG. 6 with medical gas services operating devices attached.

DETAILED DESCRIPTION OF THE PREFERRED EMBODIMENTS

In health care facilities such as hospitals, clinics and convalescent centers, it is essential that medical gas services, such as vacuum, compressed air and oxygen, be immediately available in the event of a medical emergency. Modular units for supplying medical gas services have virtually supplanted the use of individual medical gas systems, such as oxygen tanks and suction machines. Although modular units eliminate the need for multiple pieces of independent equipment at the bedside, the modular unit itself can become an obstacle which interferes with medical care. In critical care units and emergency rooms, multiple medical practitioners must be able to work at the bedside at the same time.

Also, the patient must be accessible from virtually every position around the bed, from the head, the foot and the length of both sides. The present invention provides a modular medical gas services unit in the form of a narrow tower or column which is accessible from all sides and occupies little space.

Most modular units provide multiple outlets for medical gases, as well as electrical outlets, telephone outlets, clocks and other services. Although electrical outlets, for example, can be placed in a wide range of locations—i.e., high and low—, the outlets for medical gases must be placed at a convenient height. This is because when the medical gas operating equipment is in use, the function of the equipment must be monitored visually and the controls must be within an arm's reach. For example, medical personnel must be able to visually confirm the flow rate of an oxygen flow meter as well as to quickly adjust it. Thus, the desired level for supporting medical gas outlets usually is between about 40 inches and about 60 inches from the floor.

The operating devices for medical gases, such as vacuum control units and collections containers, as well as oxygen flow meters and humidification containers, are large and substantially wider than the medical gas outlet to which they are connected. Thus, the number of gas outlets which can used at the same time is limited vertically and horizontally by the space needed to accommodate the dimensions of the operating equipment. Because of the height limitations (40"–60"), it is usually undesirable to mount two pieces of equipment vertically. Thus, there is a need to provide as many medical gas outlets as possible at the same height but in a confined space. The modular medical gas services column of this invention is provided with multiple medical gas outlets at the same height, and the outlets are spaced a sufficient distance apart to accommodate a wide range of conventional operating equipment.

The Embodiment of FIGS. 1–5

Figure 1:
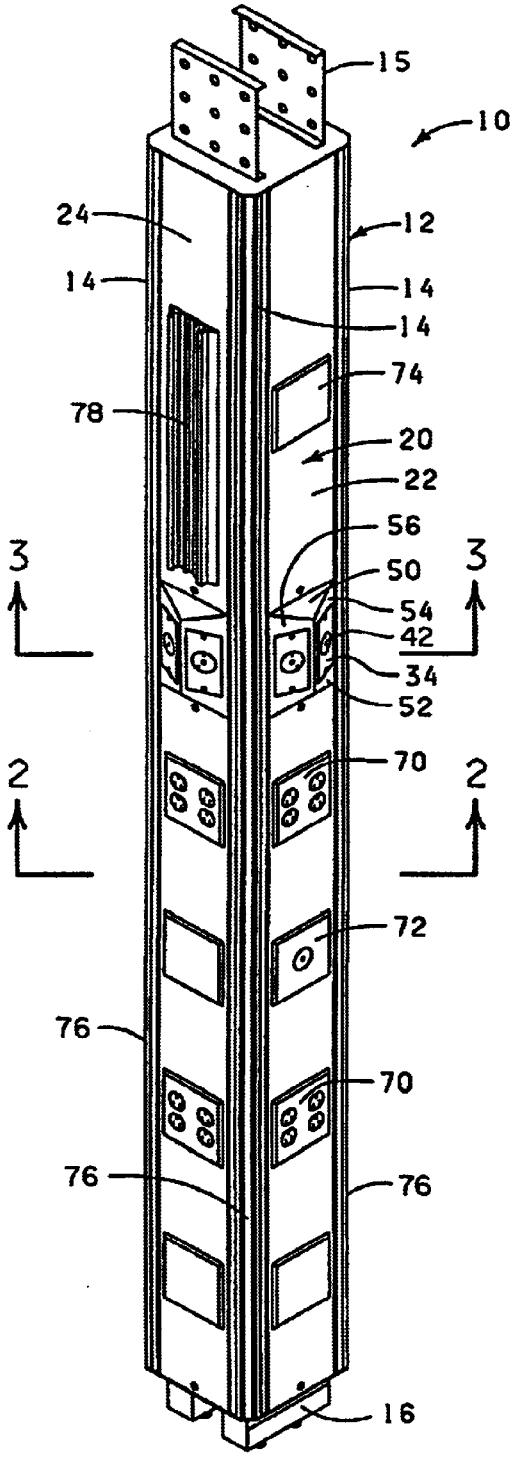
FIG. 1 is a perspective view of a modular medical gas services column constructed in accordance with the present invention.

With reference now to the drawings in general and to FIG. 1 in particular, there is shown therein a modular medical gas services column in accordance with the present invention. The column, designated generally by the reference numeral 10, comprises a narrow vertical frame 12.

In most instances the frame 12 will be sized for placement between the floor and ceiling of a medical facility. Thus, the column 10 may be equipped with brackets 15 and feet 16 by which the frame 12 is anchored in the selected location.

The frame 12 may be conveniently formed by vertical corner members 14 joined by multiple cross members (not shown). The frame 12 defines an external support surface 20. As seen in the embodiment of FIGS. 1–5, the external support surface 20 is formed of at least one planar surface and preferably four planar surfaces, such as the side panels 22, 24, 26 and 28. The side panels 22, 24, 26 and 28 are connected in some suitable manner to the vertical corner members 14 or the internal cross members or both to form a column which is square in cross-section. See FIGS. 2 and 3. Thus, in the preferred embodiment shown in FIGS. 1–5, the external support surface 20 forms a hollow tubular structure so that the surface 20 encloses an internal space 30.

Figure 3:
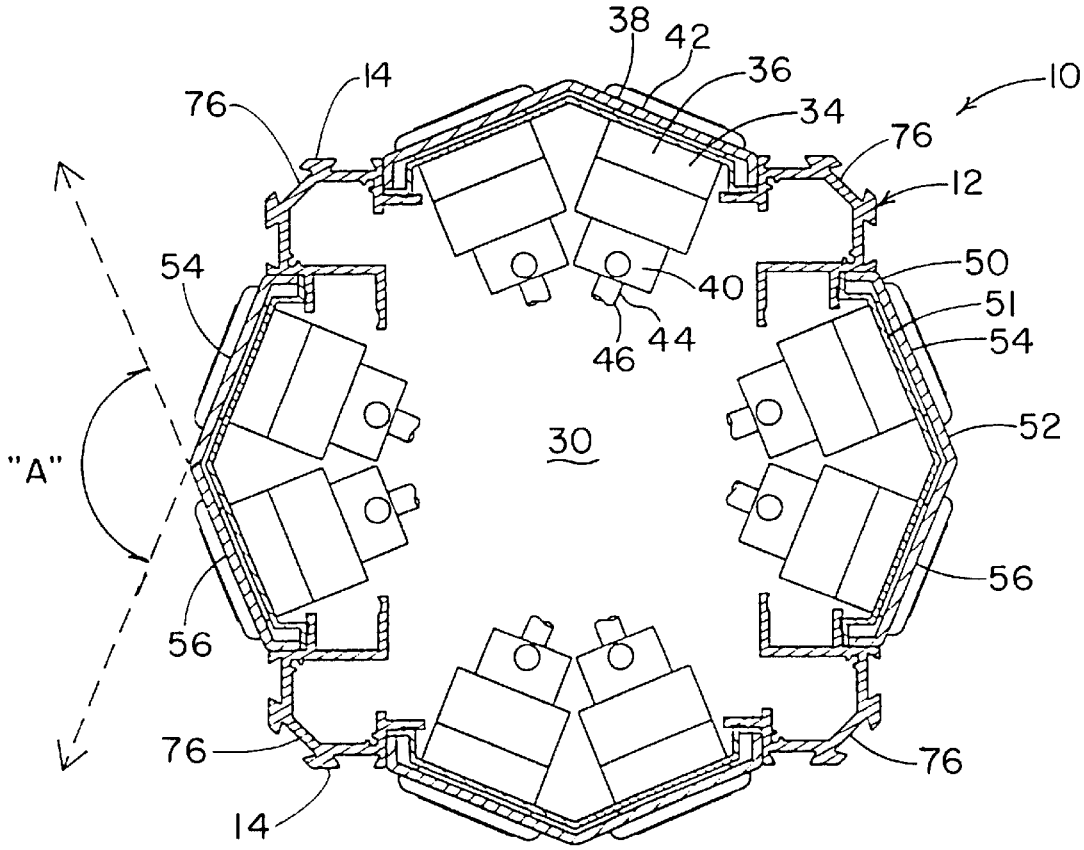
FIG. 3 is a cross sectional view of the modular medical gas services column shown in FIG. 1 taken along the line 3—3.

As seen in FIGS. 1 and 3, at least two medical gas supply assemblies 34 are mounted on the surface 20. Even more preferably, eight medical gas supply assemblies 34 are supported on the surface 20 around the frame 12 and preferably all at about the same height on the frame 12. As previously indicated, the desired height usually will be between about 40 inches and about 60 inches from the floor (not shown).

Referring to FIG. 3, the medical gas supply assembly 34 includes an outlet housing 36 having a first end 38 and a second end 40. An outlet 42 (see also FIG. 1) is supported on the first end 38 so that it is accessible from near the column 10. The second end 40 extends into the internal space 30 of the frame 12. In most instances, the medical gas supply assembly will include a gas conduit 44 (see FIG. 5). The conduit 44 has a first end 46 (FIG. 3) connected to the second end 40 of the medical gas outlet housing 36 and a second end 48 adapted to be connected to a medical gas supply. However, in some cases, the conduit may be attached during installation of the column 10 on site.

With continuing reference to FIGS. 1 and 3, the width of each of the side panels 22, 24, 26 and 28 is only slightly wider than a conventional medical gas outlet. Thus, using conventional components, only four medical gas outlets could be mounted at the same level on a column this narrow.

However, the number of gas supply assemblies 34 which can be mounted on this narrow, four-sided column 10 is doubled by employing an angled outlet panel 50. At least one angled outlet panel 50 may be provided on each side panel 22, 24, 26 and 28.

The angled outlet panel 50 comprises generally an angled support bracket 51 by which the medical gas supply assembly is mounted to the frame 12 by screws or some suitable means (not shown). A molded trim cover 52 is attached over the bracket 51. In the embodiment shown, the bracket 51 and cover 52 are as wide as the side panel 22. Thus, the side panel 22 is divided into an upper and lower section, and the outlet panel 50 is mounted between the sections. In some embodiments, however, the side panels may be formed of a single section.

Both the bracket 51 and the trim cover are formed into angles, thus defining first and second planar outlet support surfaces 54 and 56. The first and second planar outlet support surfaces are adjacent and angled relative to each other. Thus, the planes defined by each surface 54 and 56 intersect to form an angle "A," as illustrated in FIG. 3. Preferably, the angle A is at least 90 degrees, more preferably, angle A is an obtuse angle, and most preferably, angle A is about 135 degrees.

Figure 4:
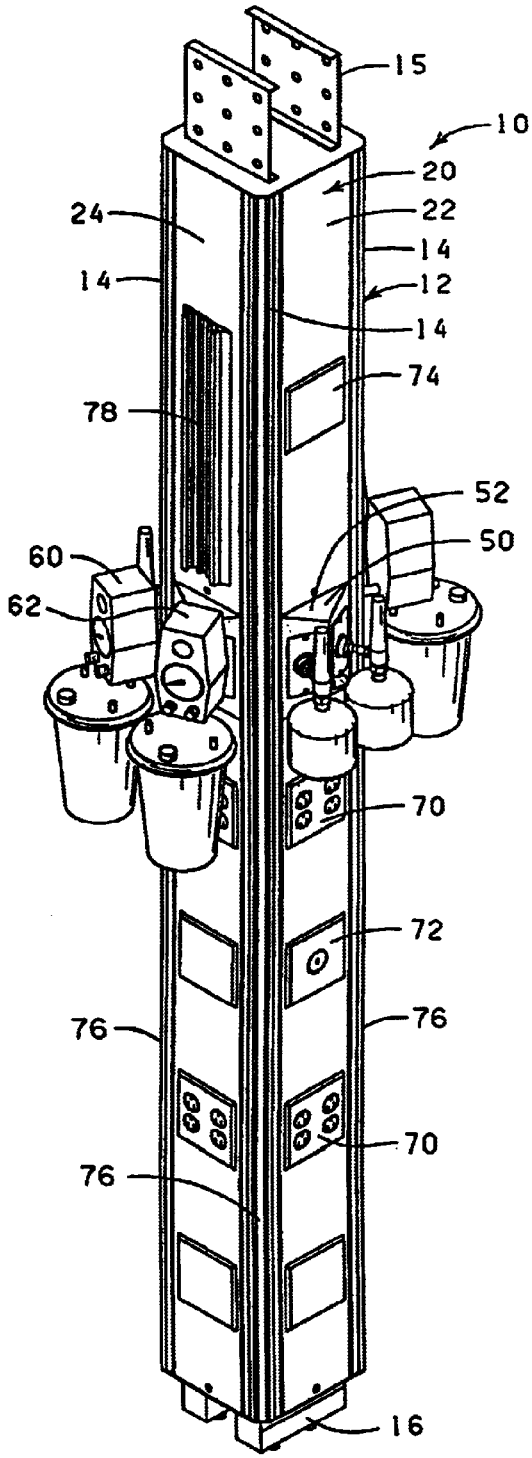
FIG. 4 is a perspective view of a modular medical gas services column in accordance with the present invention showing several items of medical gas service operating equipment connected to the medical gas outlets.
Figure 2:
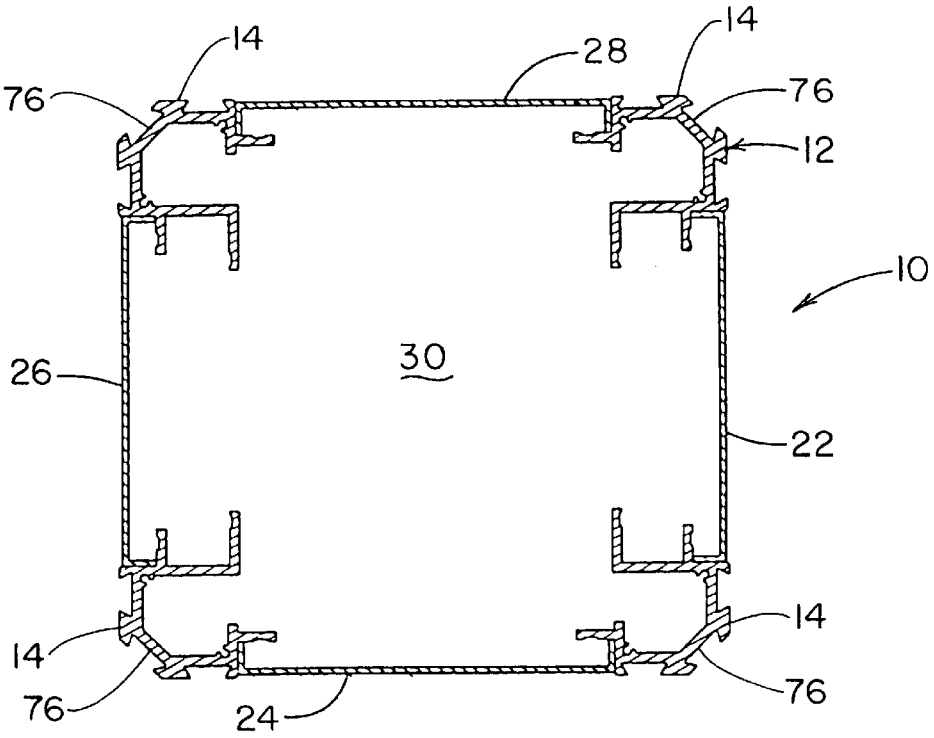
FIG. 2 is a cross sectional view of the modular medical gas services column shown in FIG. 1 taken along the line 2—2.
Figure 5:
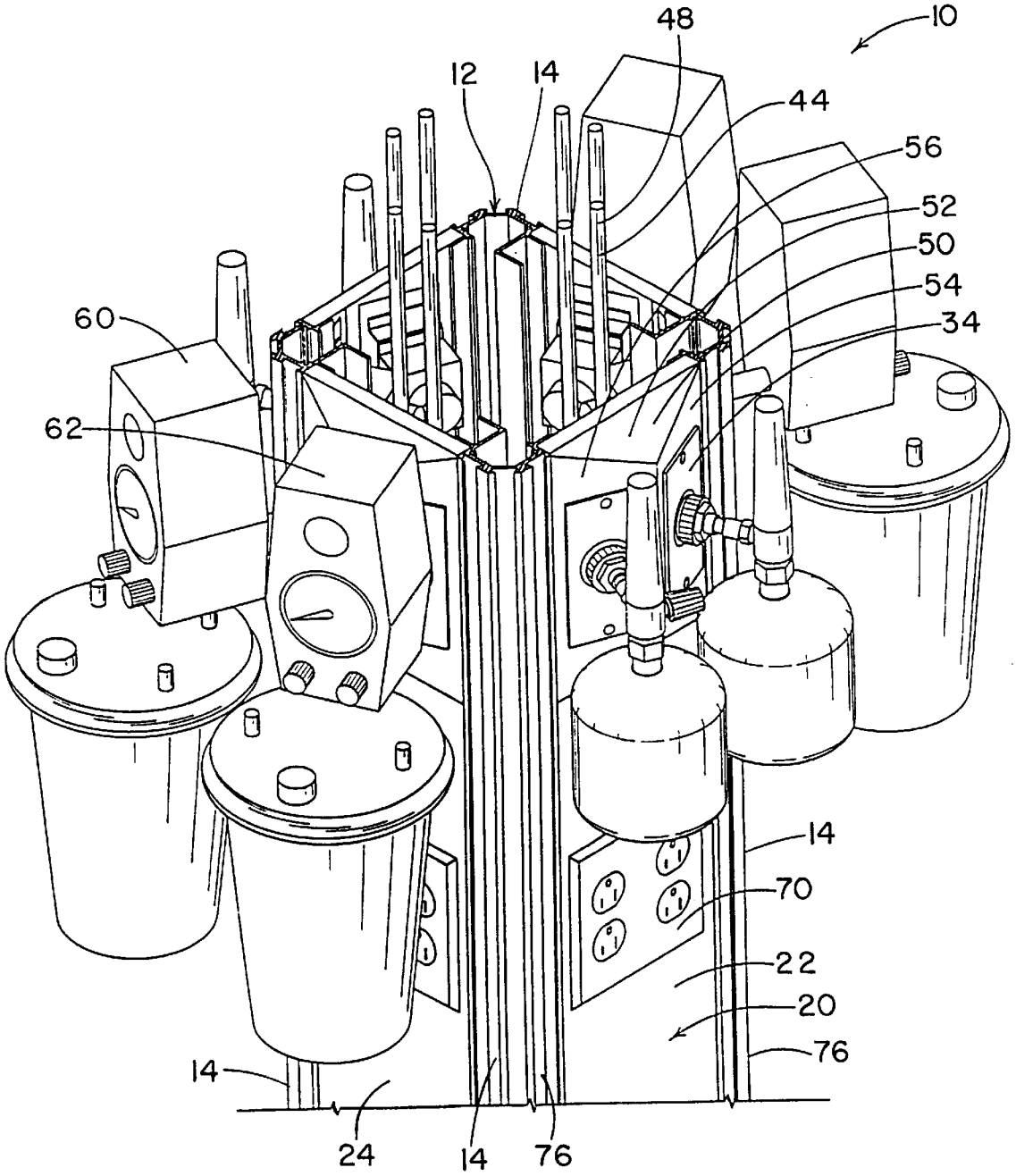
FIG. 5 is an enlarged, perspective view of a portion of the modular medical gas services column shown in FIG. 4.
Figure 5:
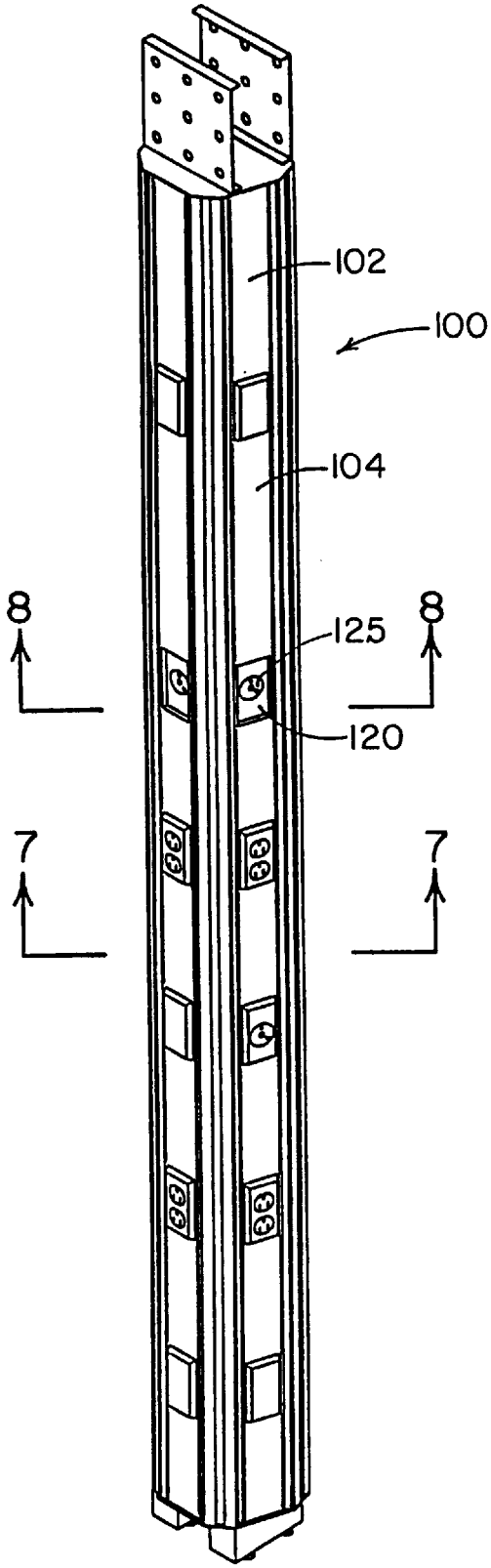

Now a major advantage of the angled medical gas outlet panel of the present invention will be apparent. As best seen in FIGS. 4 and 5, the use of the angled outlet panels 50 permits closer-placement of two pieces of medical gas services operating a equipment than is possible with two conventional planar outlet panels placed side by side. For example, the two adjacent vacuum control boxes with depending containers 60 and 62 could not be supported so closely together if connected to two medical gas outlets mounted flush in the side panel 24. For a side-by-side, flush-mounted arrangement, the width of the side panel 24 would have to be increased. This would, in turn, increase the overall size of the column 10 which is contrary to the goal of reducing space requirements in medical gas services modules.

Yet, as shown in FIGS. 1 and 4, even with the minimal overall size of the column 10 of this invention, there is ample room internally and externally for numerous other service outlets and attachment devices. For example, electrical outlets 70 can be positioned at various heights. Telephone jacks 72, and display panels for digital clocks and timers 74 can be conveniently placed along the vertical length of the side panels 22, 24, 26 and 28. Still further, the vertical corner members 14 may be formed to provide equipment mounting tracks 76, and additional equipment mounting tracks 78 can be mounted on the side panels. In this way, bracket devices permit the adjustable attachment of a wide variety of other equipment.

The Embodiment of FIGS. 6–9

Figure 7:
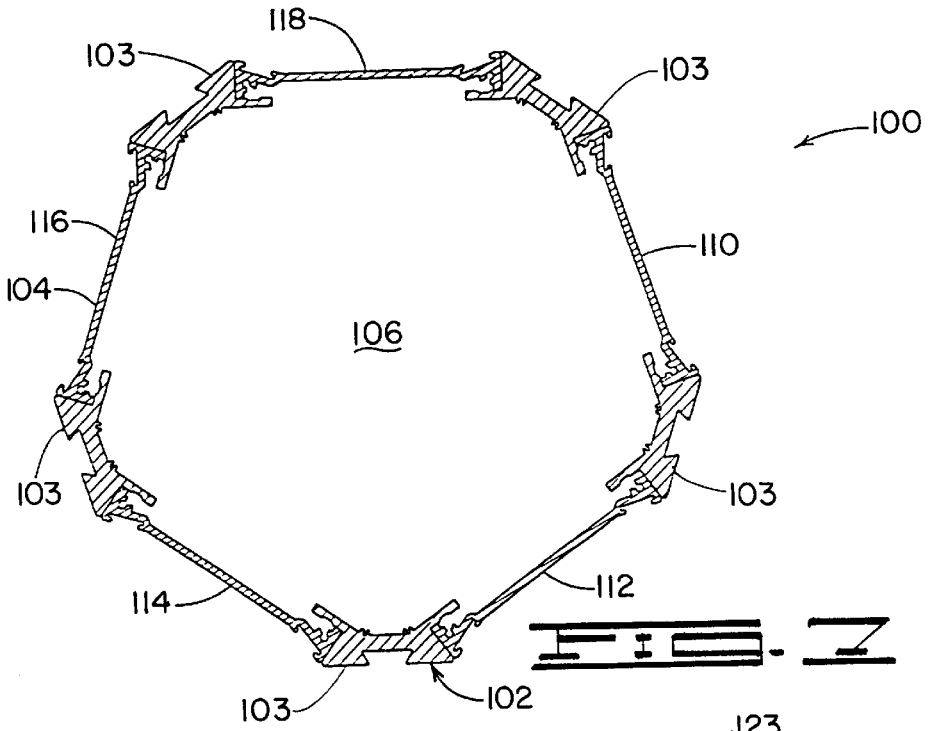
FIG. 7 is a cross-sectional view of the modular medical gas services column shown in FIG. 6 taken along the line 7—7.

Turning now to FIGS. 6–9, a second embodiment of the present invention will be described. Illustrated in FIG. 6 is a modular medical gas services column 100 comprising a vertical frame 102. As best seen in FIG. 7, a preferred frame 102 comprises a plurality of vertical members 103 which are connected by internal cross members (not shown). Thus, the frame 102 forms a hollow tubular structure having an external support surface 104 which encloses an internal space 106. Although the external support surface 104 may take several forms, a preferred configuration comprises five planar side panels 110, 112, 114, 116 and 118 of equal width.

In the preferred construction, the width of each side panel is only sightly greater than the width of a conventional medical gas service outlet. In this way, a medical gas outlet may be place on each side panel 110, 112, 114, 116 and 118 at about the same height.

Figure 8:
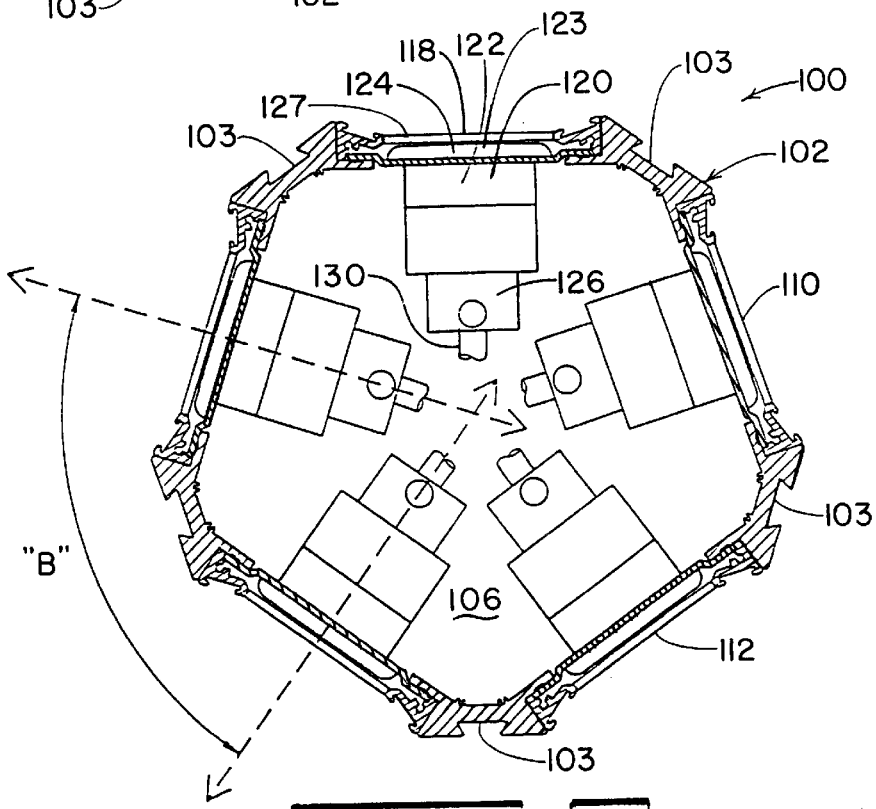
FIG. 8 is a cross-sectional view of the modular medical gas services column shown in FIG. 6 taken along the line 8—8.
Figure 5:
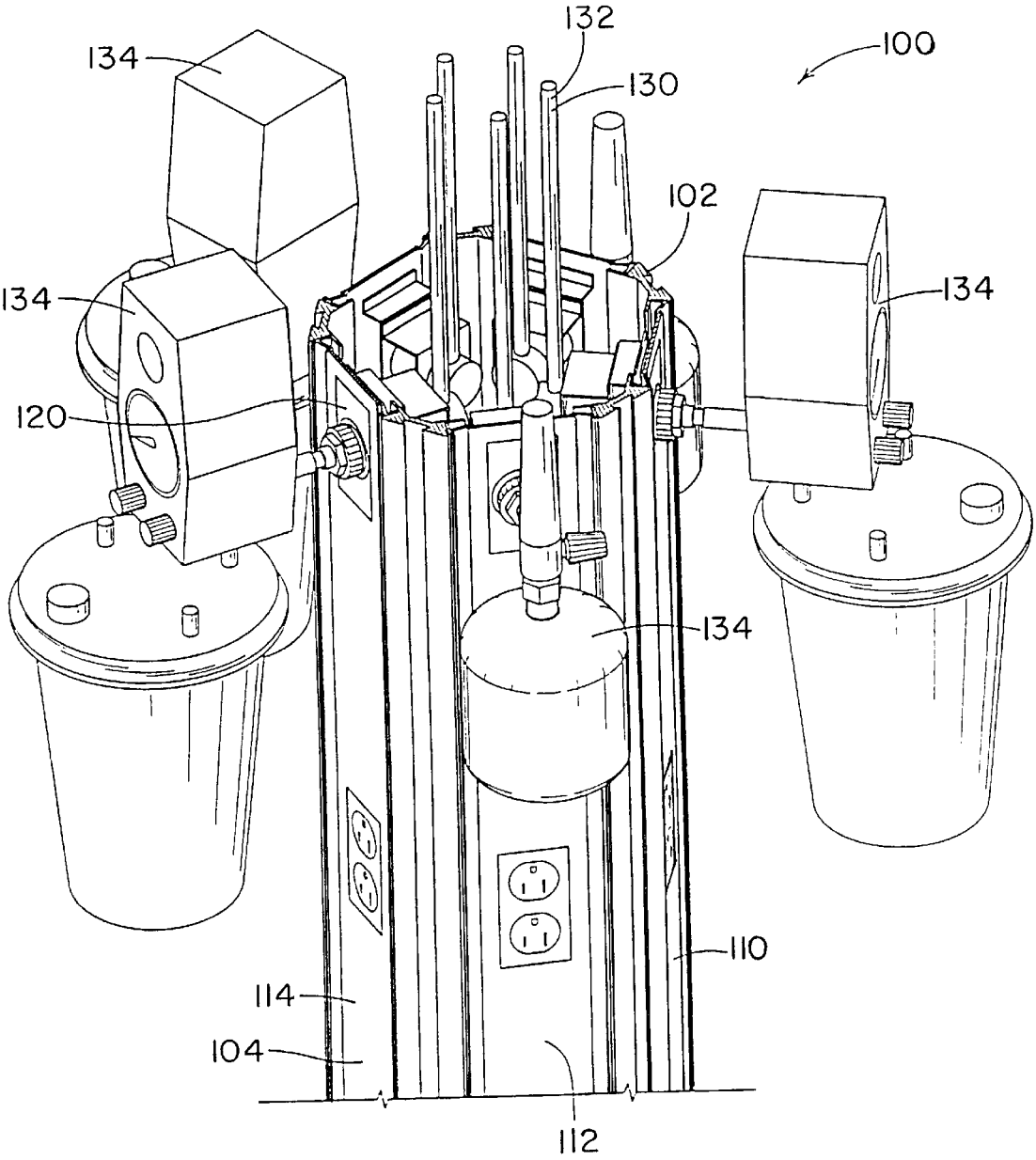

To that end, the column 100 comprises at least two medical gas supply assemblies, one of which is designated by the reference numeral 120. As shown in FIG. 8, the medical gas supply assembly 120 comprises generally an outlet housing 122 mounted on a bracket 123 which is attached to the vertical members 103 of the frame 102.

The outlet housing 122 has a first end 124 supporting the exposed outlet 125 and a second end 126 which extends into the internal space 106. A window 127 is cut in the side panel 118 to expose the outlet 125. The second end 126 of the outlet housing 122 is adapted to be connected to a gas conduit 130 which is contained in the internal space 106. As best seen in FIG. 9, the other end 132 of the gas conduit 130 is adapted to be connected to a medical gas supply (not shown).

Returning to FIG. 8, it now will be understood that the longitudinal axis of each of the medical gas supply assemblies 120 extends generally radially from the center of the internal space 106 or the longitudinal axis of the frame 102. Thus, the intersection of the longitudinal axes of any two adjacent outlet housings 120 forms an acute angle, designated herein as "B." The acuity of angle B will vary depending on the number of medical gas supply assemblies mounted around the frame. In the pentagonal configuration shown, angle B is about 72 degrees.

Turning once more to FIG. 9, the advantage of the present invention is illustrated further. With the medical gas supply assemblies 120 mounted radially at acute angles to each other, the number of medical gas service operating devices 134 which can be used simultaneously is increased without increasing the overall dimensions of the column 100.

Referring again to FIGS. 1–5, and particularly to FIG. 3, it will be appreciated that the medical gas supply assemblies 34 in the first embodiment using the angled outlet panels 50 also are arranged radially so that the longitudinal axes of adjacent outlet housings 36 intersect to form acute angles. However, in the first described embodiment, the distance between the outlets is not equal; outlets in the same outlet panel 50 are closer than outlets in adjacent outlet panels. Similarly, although the angle formed by the longitudinal axes of any two adjacent outlet housings is acute, the angles are not all the same; for example, the axes of outlet housings 34 in the same outlet panel 50 is about 40 degrees, while the angle between outlet housings in adjacent outlet panels is about 50 degrees.

It will also be appreciated that the longitudinal axes of the outlet housings 36, as shown in FIG. 3, do not extend radially precisely from the center of the internal space 30 of the longitudinal axis of the frame 12. Nevertheless, for purposes of this invention, the expression "generally radially" is intended to include such a slightly offset arrangement as is found in the embodiment of FIGS. 1–5.

Changes may be made in the combination and arrangement of the various parts, elements, steps and procedures described herein without departing from the spirit and scope of the invention as defined in the following claims.

What is claimed is:

1. A modular medical gas services column comprising:

a vertical frame defining at least one planar external support surface having a front surface and a rear surface and an internal space behind the rear surface;

at least one angled medical gas outlet panel permanently mounted on the front surface of a single one of the at least one external support surface, the at least one angled outlet panel having first and second planar outlet support surfaces, which outlet support surfaces are adjacent and define planes which intersect to form an angle; and at least one medical gas supply assembly permanently supported in each of the first and second planar outlet support surfaces on the outlet panel, each at least one medical gas supply assembly including:

an outlet housing supported in the planar outlet support surface, the housing having a first end with an exposed outlet and a second end extending into the internal space of the frame.

2. The modular medical gas services unit of claim 1 comprising a plurality of flat external support surfaces with at least one angled medical gas outlet panel on at least two of the external support surfaces and wherein the at least one medical gas supply assembly comprises at least two medical gas supply assemblies including a medical gas supply assembly on each of the at least two angled medical gas outlet panels.

3. The modular medical gas services unit of claim 2 comprising four external support surfaces, forming a unit which is substantially square in cross-section, wherein at least one angled medical gas outlet panel is supported on each of the four external support surfaces, all at about the same height, and further comprising a medical gas supply assembly supported in each angled medical gas outlet.

4. The modular medical gas services unit of claim 1 wherein the angle formed by the intersecting planes defined by the first and second planar outlet support surfaces is at least 90 degrees.

5. The modular medical gas services unit of claim 4 wherein the angle formed by the intersecting planes defined by the first and second planar outlet support surfaces is an obtuse angle.

6. The modular medical gas services unit of claim 5 wherein the angle formed by the intersecting planes defined by the first and second planar outlet support surfaces is between about 120 and about 150 degrees.

7. The modular medical gas services unit of claim 6 wherein the angle formed by the intersecting planes defined by the first and second planar outlet support surfaces is about 135 degrees.

8. The modular medical gas services unit of claim 1 wherein the medical gas supply assembly further comprises a gas conduit in the internal space of the frame, the gas conduit having a first end connected to the second end of the outlet housing and a second end adapted to be connected to a medical gas supply.

9. The modular medical gas services unit of claim 1 wherein the frame defines a hollow tubular structure which encloses the internal space.

10. A modular medical gas services unit comprising:

a vertical frame having at least one planar external support surface with a front surface and a rear surface and an internal space behind the rear surface, the frame having a longitudinal axis;

a medical gas outlet panel mounted upon the external support surface;

at least two medical gas supply assemblies permanently mounted on a single one of the at least one planar external support surface of the frame, all at about the same height on the frame, and each medical gas supply assembly including:

an outlet housing mounted in the medical gas outlet panel, the outlet housing having a first end with an exposed outlet and a second end extending into the internal space of the frame, the outlet housing having a longitudinal axis extending generally radially from the longitudinal axis of the vertical frame; and wherein the intersection of the longitudinal axes of the outlet housings of the at least two medical gas supply assemblies is an acute angle.

11. The modular medical gas services unit of claim 10 wherein the external support surface defines at least two adjacent planar sides and wherein one medical gas supply assembly is mounted on each of the at least two adjacent planar sides.

12. The modular medical gas services unit of claim 10 wherein each medical gas supply assembly further includes a gas conduit in the internal space of the frame, the gas conduit having a first end connected to the second end of the outlet housing and a second end adapted to be connected to a medical gas supply.

13. The modular medical gas services unit of claim 10 comprising at least five medical gas supply assemblies and wherein the medical gas supply assemblies are mounted equal distances apart.

* * * * *